US006938286B1

(12) United States Patent
Smith

(10) Patent No.: US 6,938,286 B1
(45) Date of Patent: Sep. 6, 2005

(54) WHEEL CHAIR ACCESSIBLE CRIB

(76) Inventor: Brack E Smith, 2029 Victory Dr., Erie, PA (US) 16510

( * ) Notice: Subject to any disclaimer, the term of this patent is extended or adjusted under 35 U.S.C. 154(b) by 0 days.

(21) Appl. No.: 10/733,050

(22) Filed: Dec. 10, 2003

(51) Int. Cl.[7] ..... A47D 7/00
(52) U.S. Cl. ..... 5/100; 292/202
(58) Field of Search ..... 5/93.1, 100, 425, 5/428, 430; 292/203, 204, 202; 160/117, 160/118, 199, 206

(56) References Cited

U.S. PATENT DOCUMENTS 2,477,231 A * 7/1949 Bourdon ..... 5/93.1
2,533,983 A * 12/1950 Weigle et al. ..... 5/2.1
2,555,160 A * 5/1951 Schwarz ..... 5/93.1
3,390,418 A * 7/1968 Sheridan ..... 16/93 R
3,403,412 A * 10/1968 Gottfried et al. ..... 5/100
D231,874 S * 6/1974 Weigel et al. ..... D6/391
4,295,514 A * 10/1981 Johnson ..... 160/206
4,959,878 A * 10/1990 Essek ..... 5/424
5,742,959 A * 4/1998 Froelich ..... 5/93.1
6,418,590 B1 * 7/2002 Nipper et al. ..... 16/382
2003/0126680 A1 * 7/2003 Stephen ..... 5/93.1

* cited by examiner

*Primary Examiner*—Michael Safavi
(74) *Attorney, Agent, or Firm*—Richard K Thomson

(57) ABSTRACT

A crib is sized to permit the legs of a wheel chair bound care giver to fit beneath the bed. The access side of the crib is equipped with at least one laterally opening door which folds out of the way to provide access to the infant. More preferably, the access side of the crib is formed by a pair of bi-fold doors which are secured by a pair of latches which are resistant to operation by anyone other than the caregiver.

1 Claim, 1 Drawing Sheet

WHEEL CHAIR ACCESSIBLE CRIB

BACKGROUND AND SUMMARY OF THE INVENTION

The present invention is directed to the field of child care. More particularly, the present invention is directed to a crib that is wheel chair accessible.

Currently, people who are wheel chair bound cannot effectively care for an infant who sleeps in a crib. Most cribs have a droppable side which prevents the wheel chair from approaching the crib to a proximity where the child may be picked up. Attempts to sidle up to the crib and reach over the side of the crib, subject both the care giver and the infant to possible injury.

It is the purpose of the present invention to provide a wheel chair bound care giver with a crib that will afford her/him with a baby bed that will permit safe access to the infant. The handicapped accessible crib of the present invention permits access by a wheel chair bound care giver, the wheel chair having a conventional maximum width and seat height, said crib comprising at least two end supports spaced by a width greater than the maximum width of the wheel chair; a central bed extending between said at least two end supports, said central bed portion having a lowermost extent which exceeds the seat height of the wheel chair by an amount sufficient to accommodate a lap of the care giver; two side frame members for restraining an infant; at least one of said side frame members having at least one access door which pivots out of the way in a manner to permit said wheel chair bound care giver to access the infant without interfering with the approach of the wheel chair.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figures 1, 2:
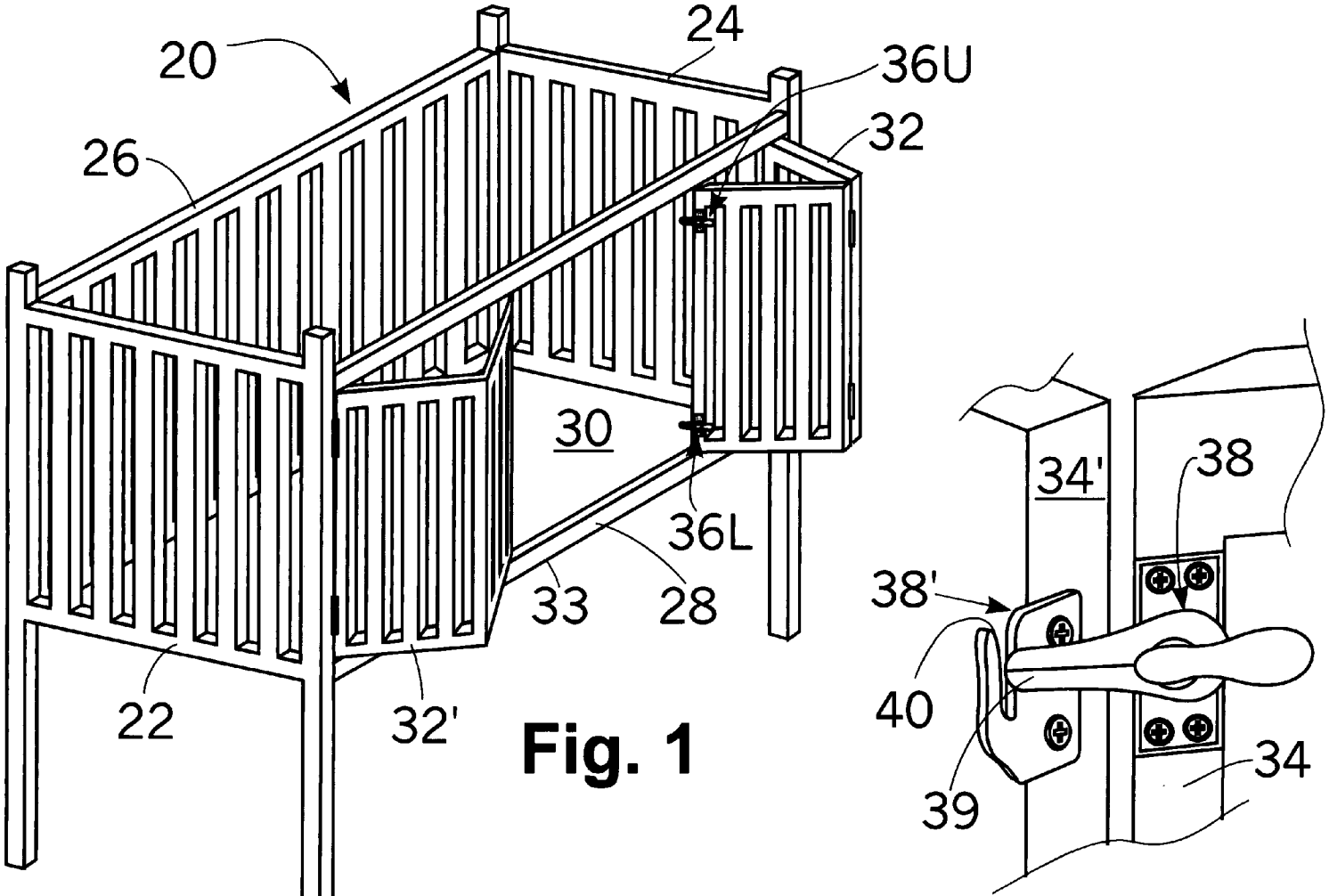
FIG. 1 is a perspective view of a first embodiment of the handicap accessible crib of the present invention.
FIG. 2 is an enlarged detail of a latch mechanism which can be used with the crib of the present invention.

A first preferred embodiment of the handicapped accessible crib of the present invention is shown in FIG. 1 generally at 20. Crib 20 comprises first end support 22 and second end support 24 which are interconnected by a first solid side 26 and access side 28 and are spaced by a distance greater than the maximum width (typically the width of the wheels) of a conventional wheel chair. The rectangular crib 20 has a bottom 30 which will support a mattress, bedding, etc. The lowest point 33 of access side 28 is higher than the seat of a conventional wheel chair by an amount sufficient to accommodate the legs/lap of the chair's occupant permitting a handicapped care giver to closely approach the crib, to the point of even placing her/his legs beneath the bottom 30, to permit the infant to be easily picked up from the crib 20. As is typical with other cribs, the height of the sides 26 and 28, and bottom 30 can be adjusted to accommodate differing height wheel chairs.

Access side 28 preferably has at least one door 32 which can be laterally retracted to permit access to the infant. More preferably, the doors comprise two bi-fold doors 32, 32' which can be laterally drawn aside to open the access side 28 for access by the care giver. Bi-fold doors 32, 32' are latched to the closed position by a pair of latches 36U, 36L, each having a first portion 38 mounted along a lateral edge 34 of door 32 and a second portion 38' mounted along an end surface 34' of door 32'. First latch portions 38 each have a tang 39 which fit in slots 40 in second portion 38'. Tangs 39 are of sufficient length and girth to prevent bi-fold doors 32, 32' from opening when the latches are in their down or secured position. First latch portions are not easily turned by an infant but can be readily operated by the care giver to permit the bi-fold doors 32, 32' to be opened. Alternatively, the latches 36, 36' could have first latch portions 38 which are spring biased to a closed position. This style latch would require the care giver to simultaneously operate the latches 36, 36' to access the infant. This reduces the possibility that older children outside the crib and more mature infants inside, could tamper with the latches placing the infant at risk to fall out of the crib 20.

The crib 20 uses a pair of latches 36, 36' to secure bi-fold doors 32, 32' for the infant's safety. The first (22) and second (24) end supports are spaced by a distance greater than the maximum width of a conventional wheel chair and the lowest point 33 of accessible side 28 is higher than the arm rests on a conventional wheel chair. The bi-fold doors 32, 32', then, enable a wheel chair bound care giver to access an infant who is in the crib 20 and to pick her/him up and replace her/him without awkward bending movements which could place both the infant and care giver at risk for injury.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A wheel chair accessible crib permitting access by a wheel chair bound care giver, the wheel chair having a conventional maximum width and seat height, said crib comprising a) at least two end supports spaced by a width greater than the maximum width of the wheel chair;

b) a central bed extending between said at least two end supports, said central bed portion having a lowermost extent which exceeds the seat height of the wheel chair by an amount sufficient to accommodate a lap of the care giver;

c) two side frame members for restraining an infant;

d) at least one of said side frame members having a pair of bi-fold access doors which pivotally retract out of the way in opposite lateral directions in a manner to permit said wheel chair bound care giver to access the infant without interfering with the approach of the wheel chair;

e) latch means securing said pair of bi-fold doors, said latch means including first and second vertically aligned, independently operated pivoting latches wherein each said latch comprises a first portion mounted along a lateral edge of a first bi-fold door and a second portion mounted along an end surface of a second bi-fold door, each said second portion forming a slot, each said first portion having a tang which fit in said slot in said second portion.

* * * * *